US008690523B2

(12) United States Patent
Guemmer

(10) Patent No.: US 8,690,523 B2
(45) Date of Patent: Apr. 8, 2014

(54) FLUID FLOW MACHINE WITH RUNNING GAP RETRACTION

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1266 days.

(21) Appl. No.: 12/544,352

(22) Filed: Aug. 20, 2009

(65) Prior Publication Data

US 2010/0098536 A1 Apr. 22, 2010

(30) Foreign Application Priority Data

Oct. 21, 2008 (DE) ..... 10 2008 052 401

(51) Int. Cl.
*F04D 29/16* (2006.01)
*F04D 29/52* (2006.01)
*F04D 29/68* (2006.01)

(52) U.S. Cl.
USPC ..... 415/58.7; 415/173.1; 415/208.5; 415/211.1

(58) Field of Classification Search
USPC ..... 415/58.5, 58.6, 58.7, 208.3, 208.4, 415/208.5, 173.1, 173.2, 173.3, 173.4, 415/174.4, 211.1
See application file for complete search history.

(56) References Cited

U.S. PATENT DOCUMENTS

| | | | | |
|---|---|---|---|---|
| 3,893,782 | A * | 7/1975 | Pierpoline et al. | 415/119 |
| 3,947,148 | A | 3/1976 | Holt | |
| 4,152,094 | A | 5/1979 | Honda et al. | |
| 4,540,335 | A * | 9/1985 | Yamaguchi et al. | 415/129 |
| 4,650,394 | A * | 3/1987 | Weidner | 415/115 |
| 5,277,541 | A * | 1/1994 | Palmer | 415/58.2 |
| 6,302,643 | B1 * | 10/2001 | Kurokawa et al. | 415/119 |
| 6,435,819 | B2 * | 8/2002 | Irie et al. | 415/119 |
| 6,527,509 | B2 * | 3/2003 | Kimura et al. | 415/173.1 |
| 6,540,482 | B2 * | 4/2003 | Irie et al. | 415/221 |
| 6,726,391 | B1 * | 4/2004 | Kreis et al. | 403/28 |
| 6,832,890 | B2 * | 12/2004 | Booth | 415/173.1 |
| 6,877,953 | B2 * | 4/2005 | Guemmer | 415/216.1 |
| 7,004,722 | B2 * | 2/2006 | Teramura et al. | 415/119 |
| 7,128,522 | B2 * | 10/2006 | Jutras | 415/1 |
| 7,575,412 | B2 * | 8/2009 | Seitz | 415/58.5 |
| 8,133,003 | B2 * | 3/2012 | Davi et al. | 415/1 |
| 2002/0150469 | A1 * | 10/2002 | Bolms | 415/115 |

FOREIGN PATENT DOCUMENTS

| | | |
|---|---|---|
| DE | 3147713 | 6/1982 |
| DE | 3532636 | 5/1986 |
| DE | 60036336 | 6/2008 |
| EP | 1069315 | 1/2001 |

OTHER PUBLICATIONS

German Search Report dated Feb. 20, 2013 from Counterpart Application.

* cited by examiner

*Primary Examiner* — Edward Look
*Assistant Examiner* — Jesse Prager
(74) *Attorney, Agent, or Firm* — Timothy J. Klima; Shuttleworth & Ingersoll, PLC

(57) ABSTRACT

A fluid flow machine includes a main flow path which is confined by a hub (3) and a casing (1) and in which at least one row of blades (5) is arranged, with a blade end with gap being provided on the blade row, with the blade end and the main flow path confinement performing a rotary movement relative to each other in a vicinity of the blade end, with at least part of the running gap (11) retracted radially from the main flow path confinement into the main flow path, with the running gap (11) at the retractions no longer being confined by the main flow path confinement, but by a peripheral guiding device (10) passed by the main flow and firmly connected to the main flow path confinement and having a row of profiles (12).

24 Claims, 17 Drawing Sheets

Figure 2:
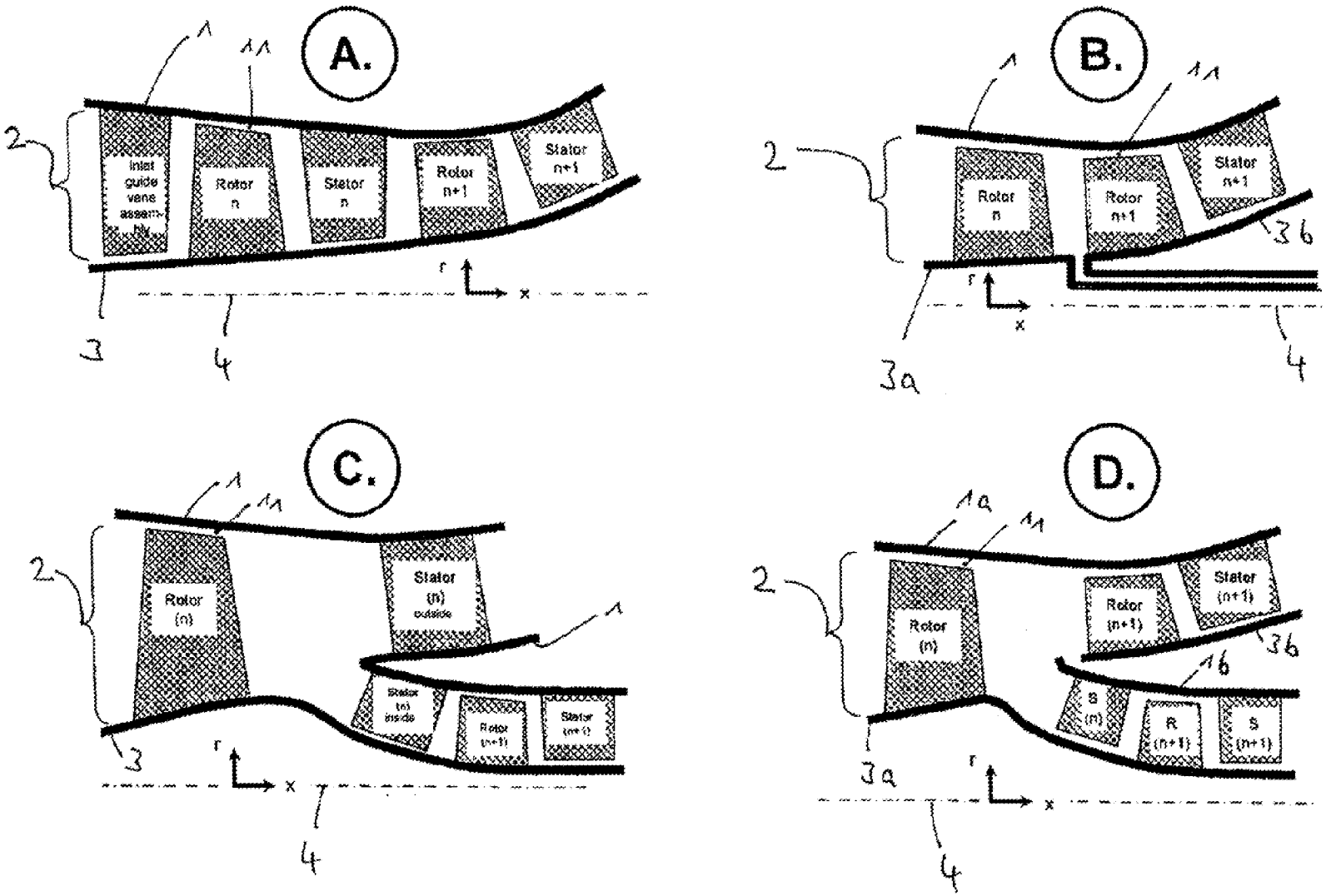
Fig. 2 (Prior Art)

Fig. 1a: State of the art
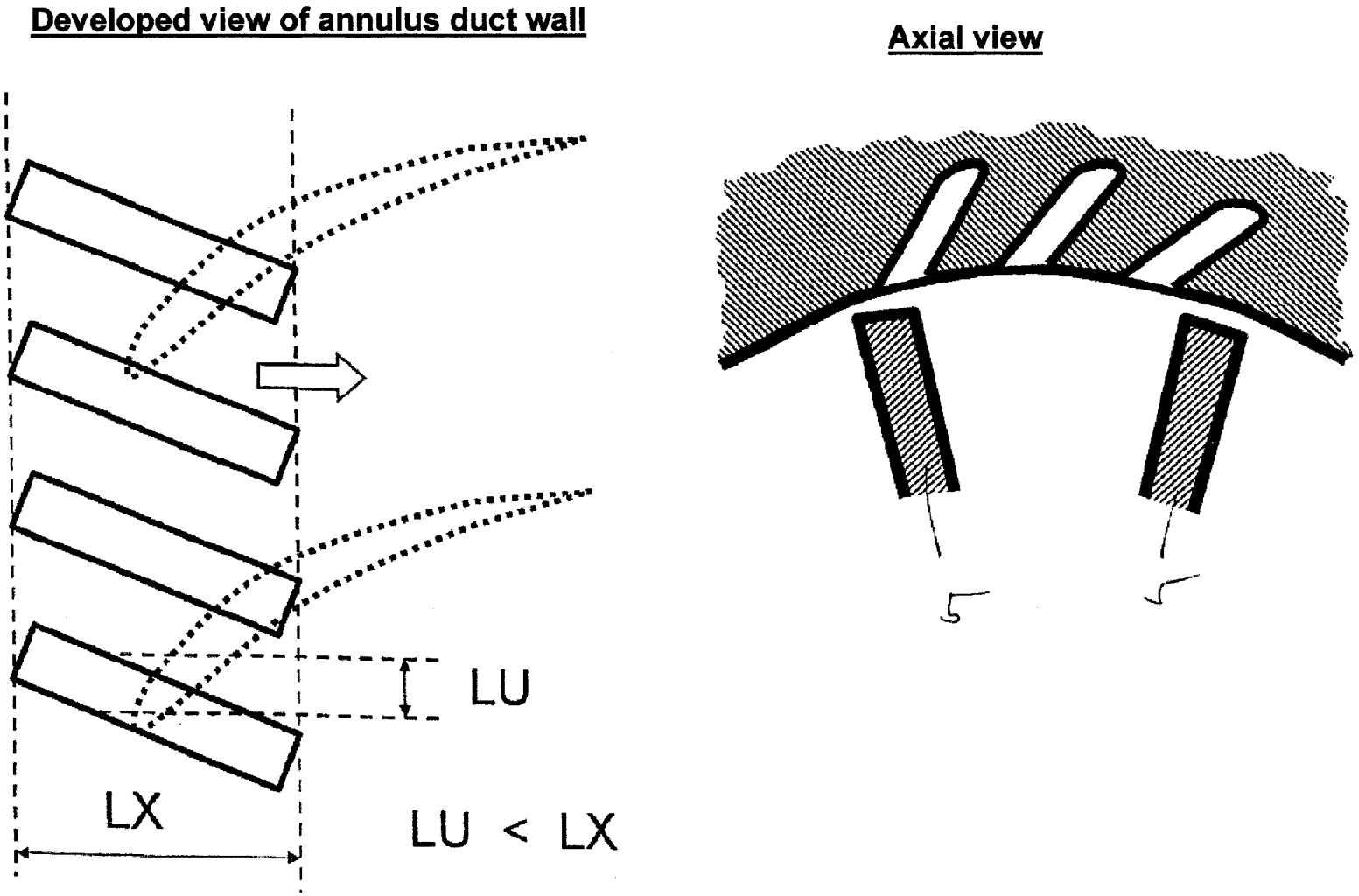

Fig. 1b: State of the art
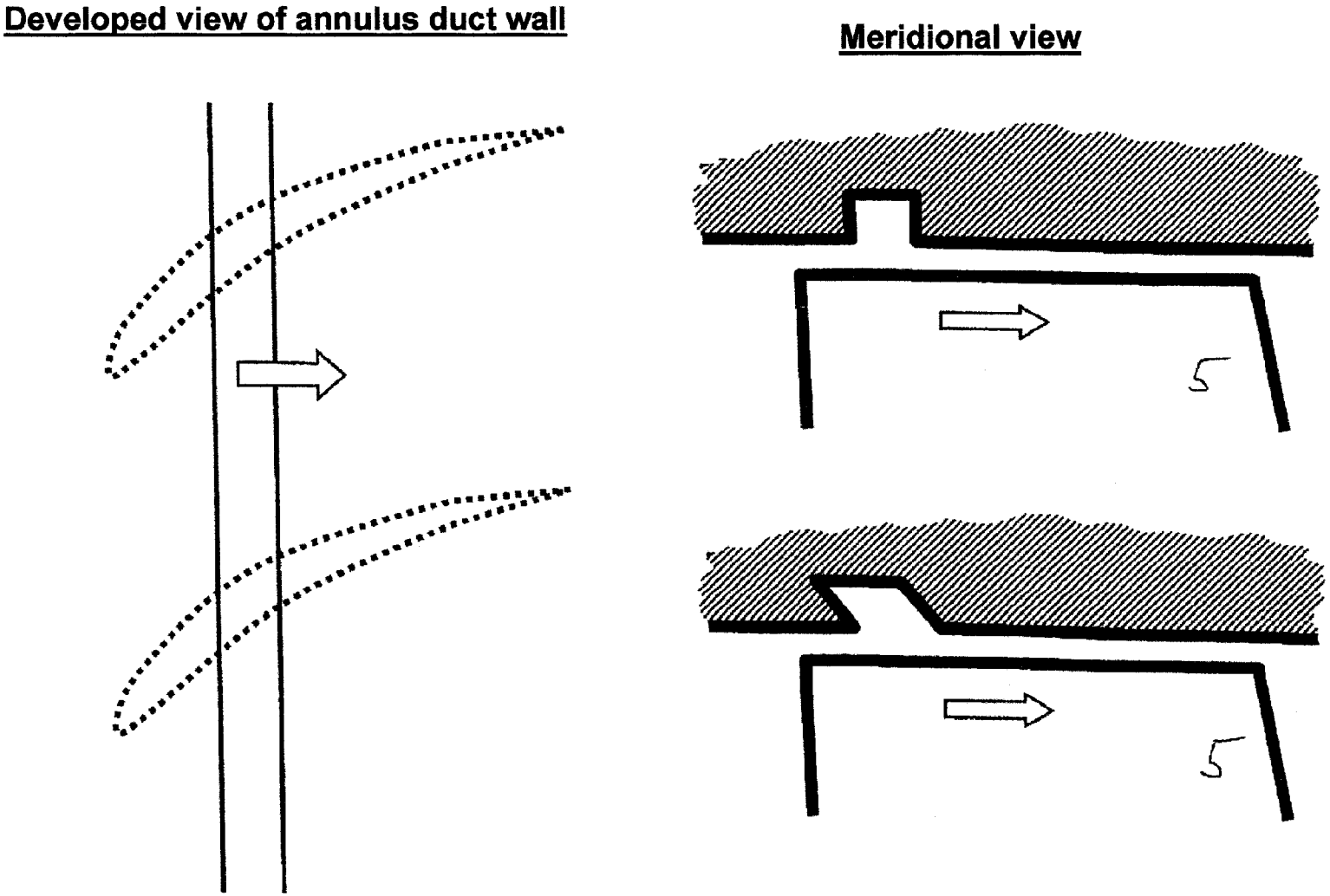

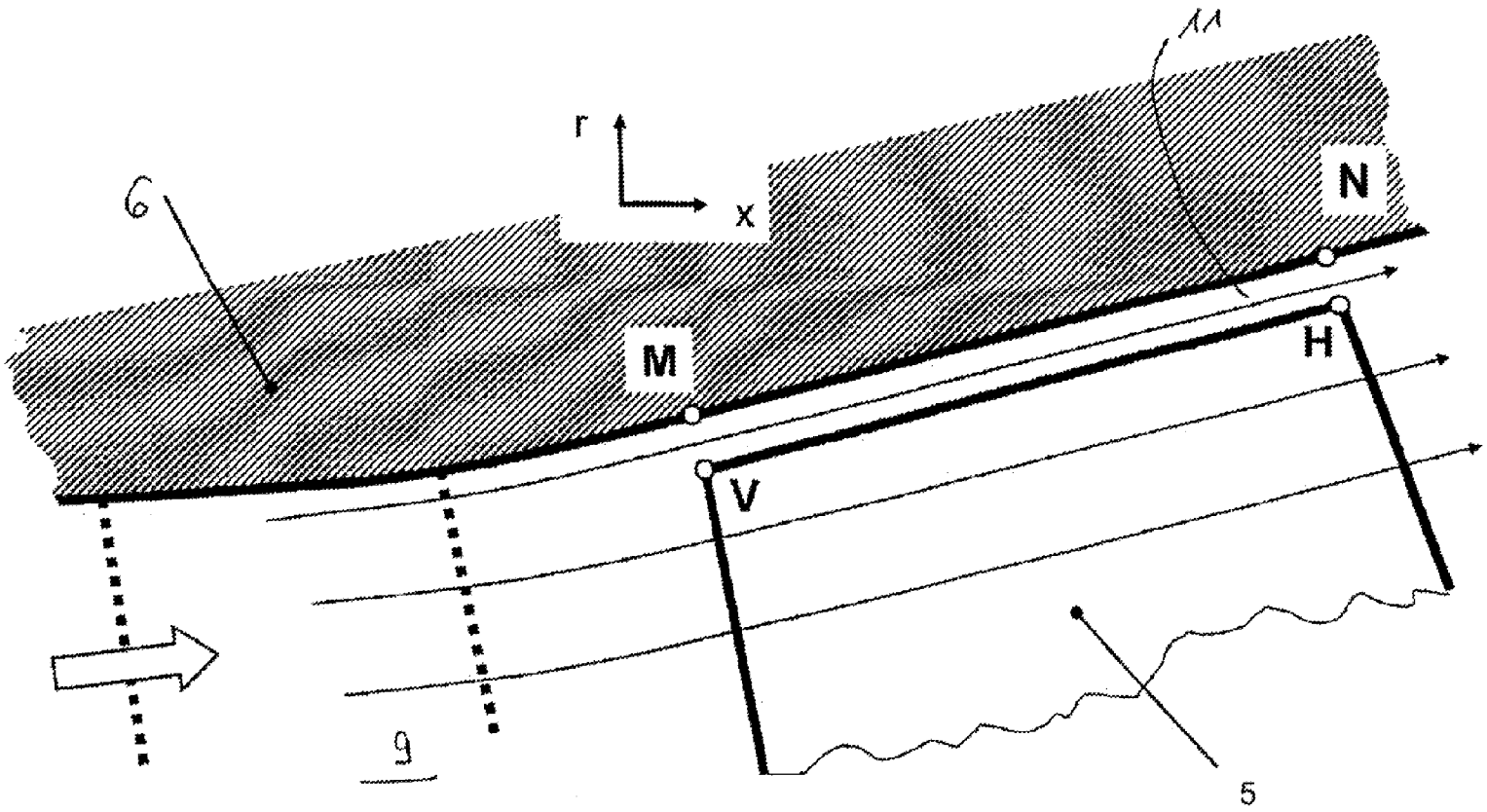
Fig. 3: State of the art

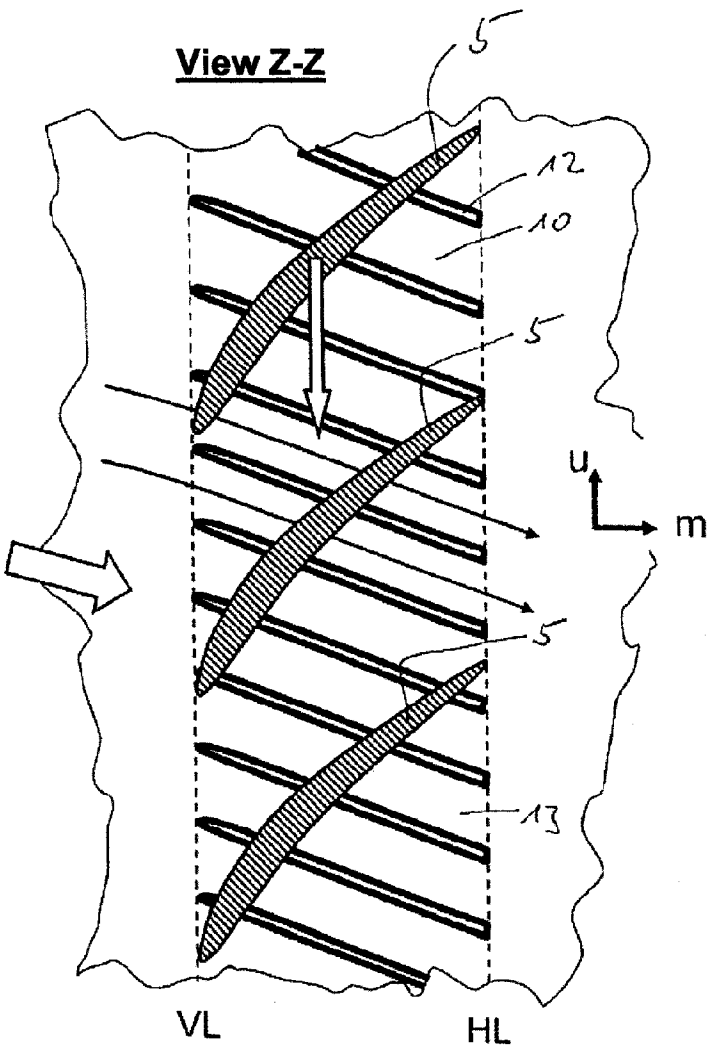
Fig. 5a:
Meridional section:
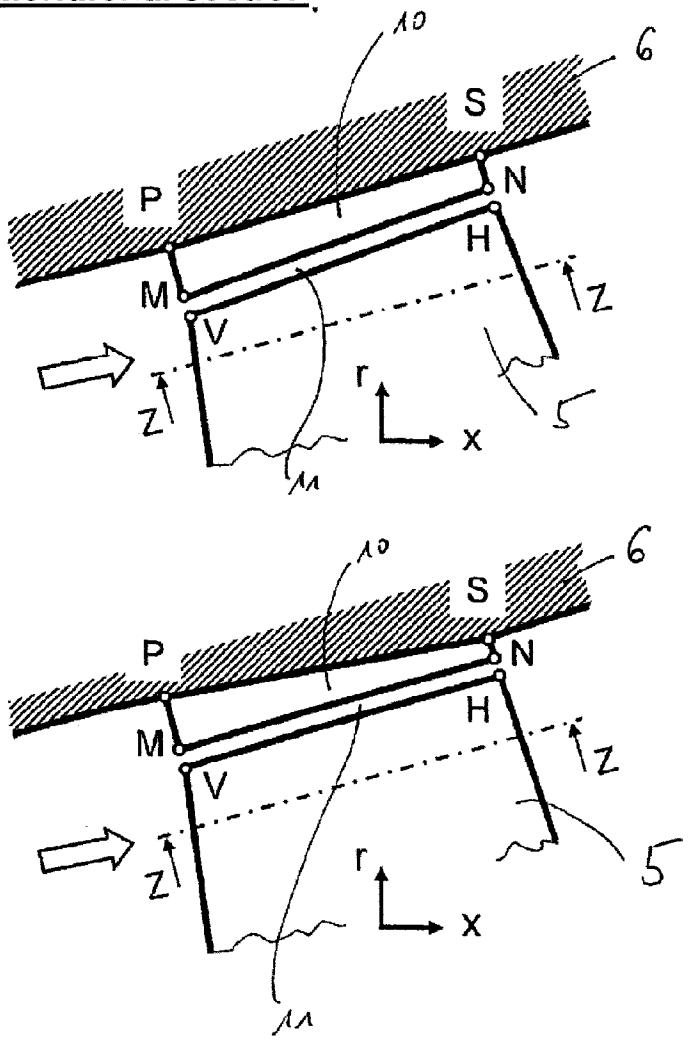

Fig. 6:
Meridional section
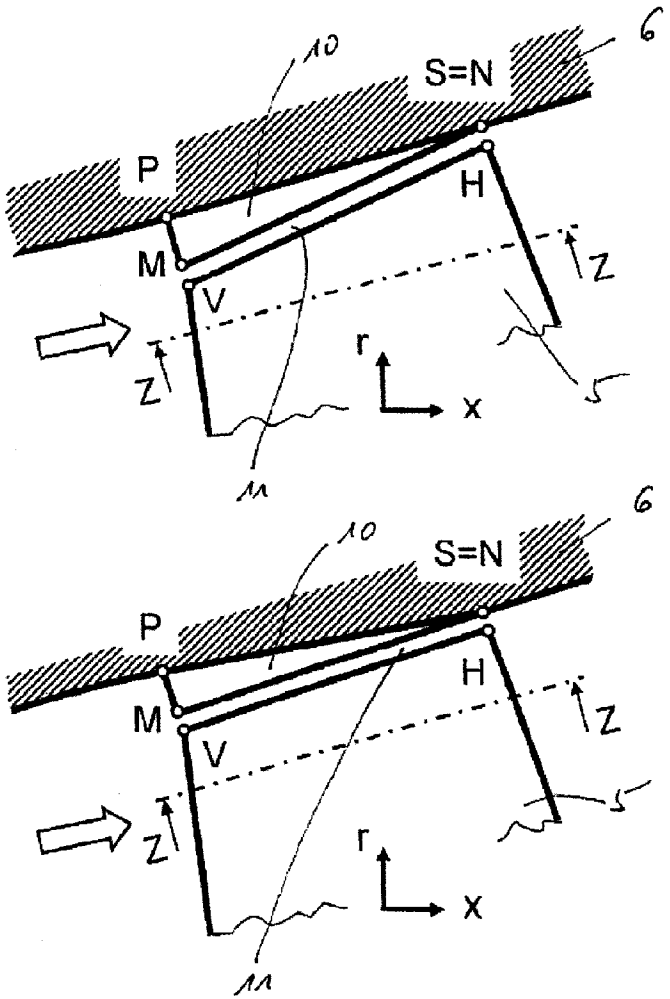
View Z-Z
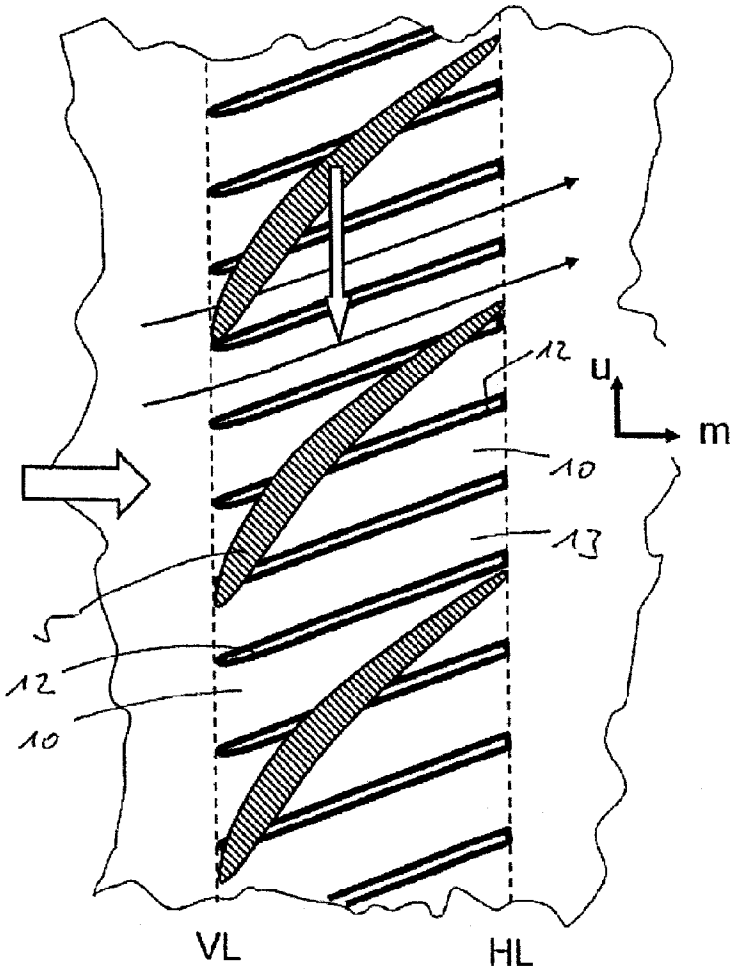

Fig. 7a:
Meridional section
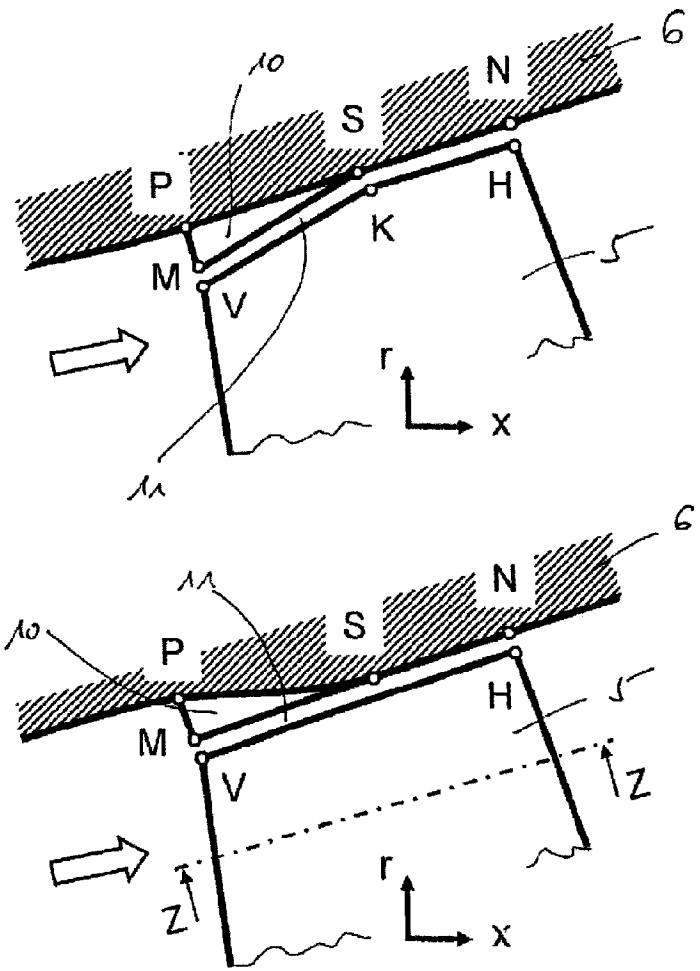
View Z-Z
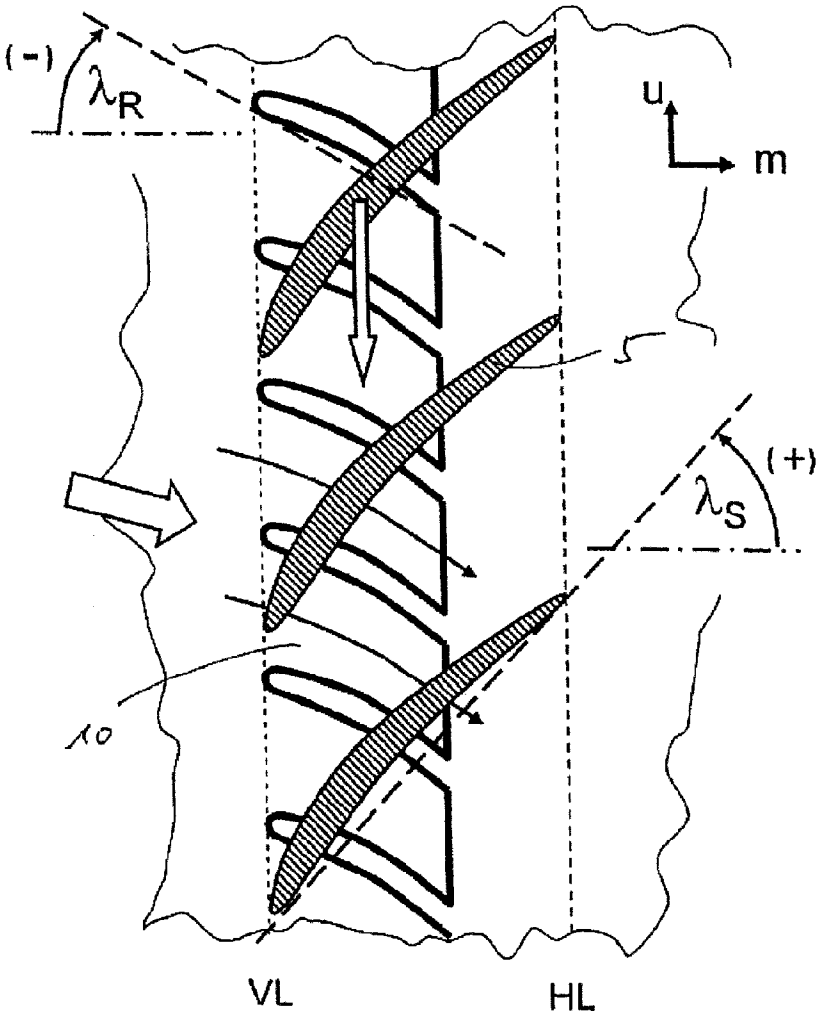

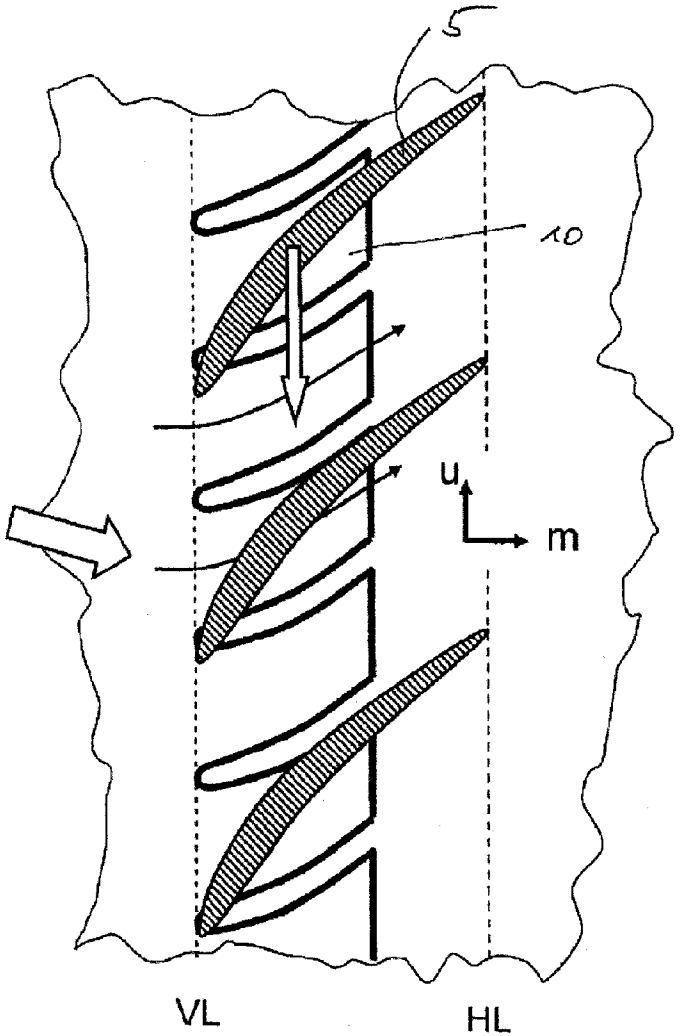
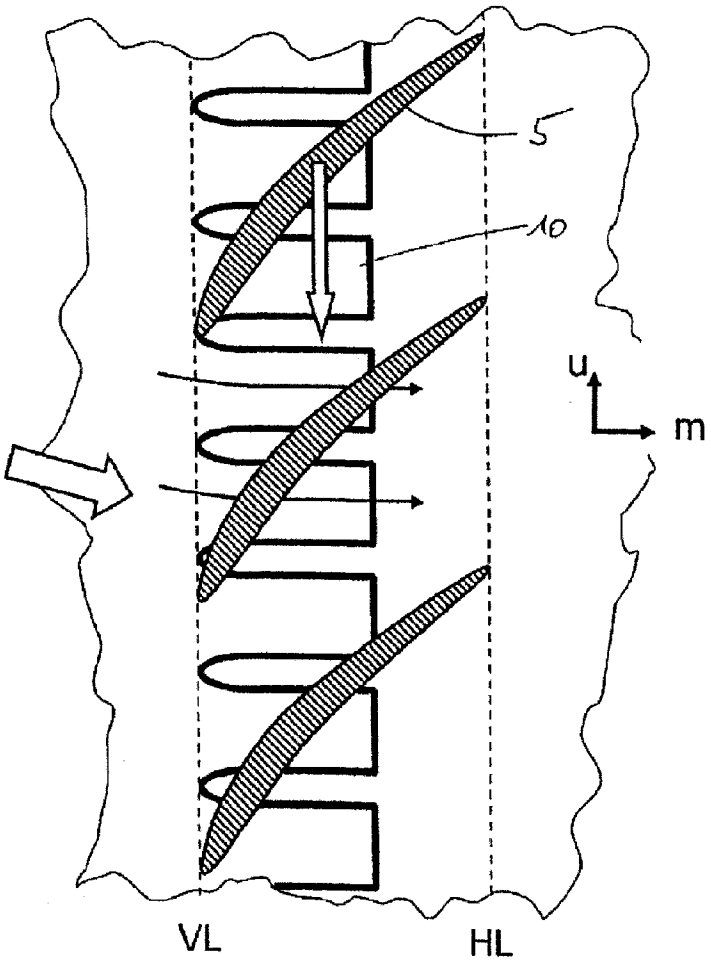
Fig. 7b:

Fig. 8:
Meridional section
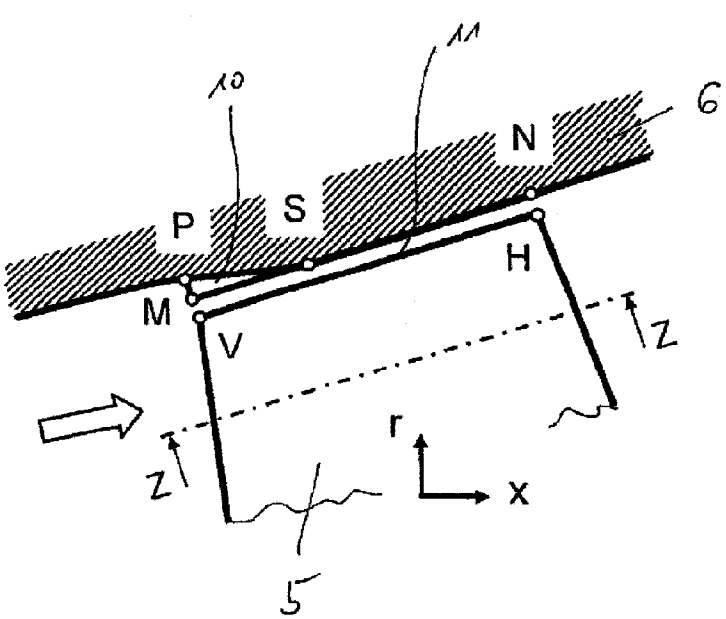
View Z-Z
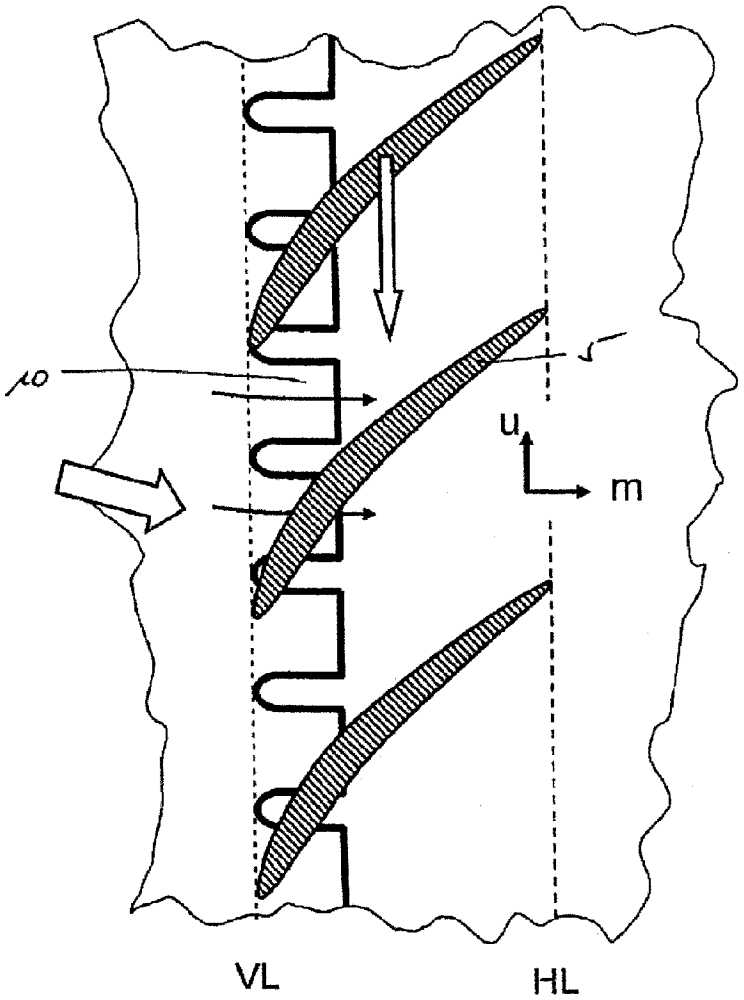

Fig. 9:
Meridional section
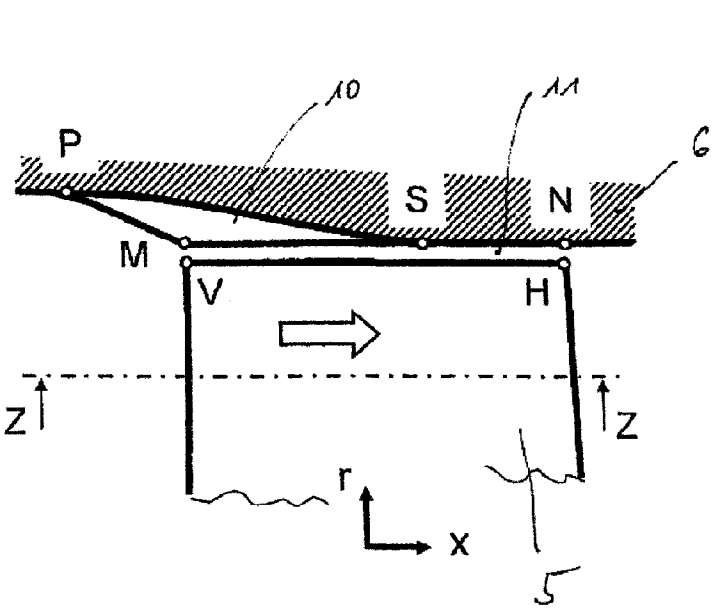
View Z-Z
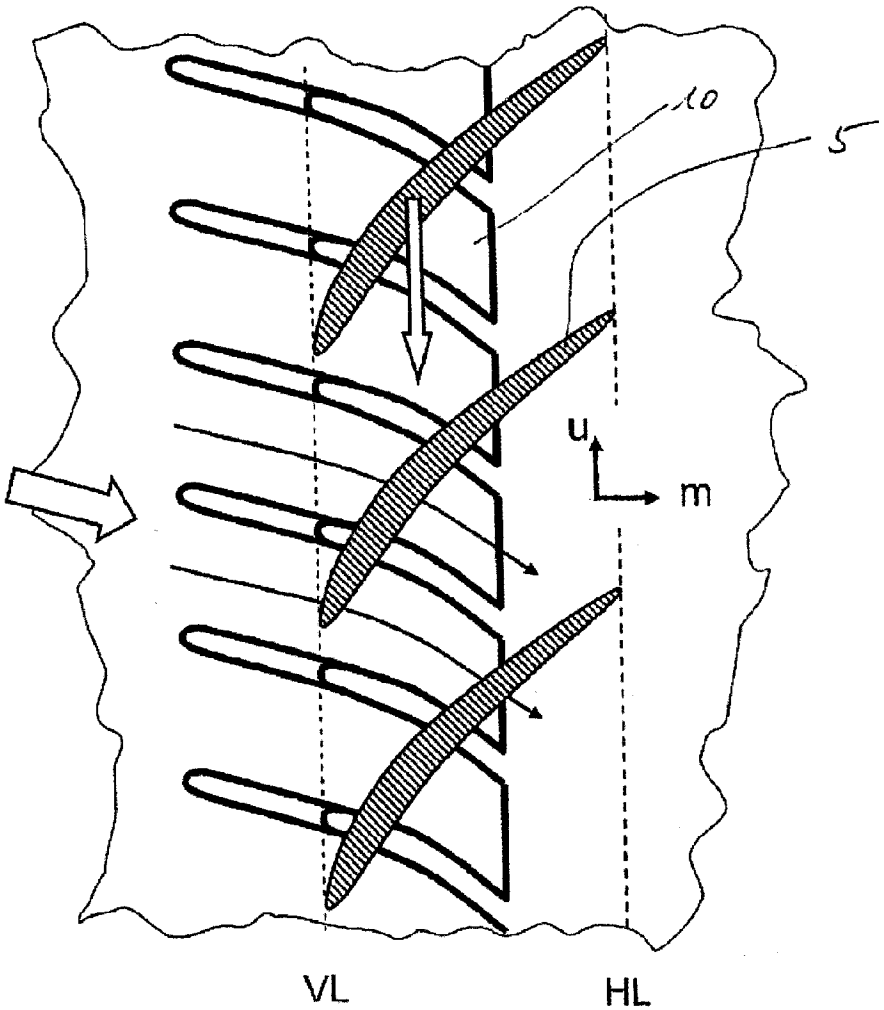

FLUID FLOW MACHINE WITH RUNNING GAP RETRACTION

This application claims priority to German Patent Application DE102008052401.8 filed Oct. 21, 2008, the entirety of which is incorporated by reference herein.

This invention relates to a fluid flow machine with running gap retraction.

The aerodynamic loadability and the efficiency of fluid flow machines such as blowers, compressors, pumps and fans, is limited in particular by the growth and the separation of boundary layers in the rotor and stator blade tip area near the casing or the hub wall, respectively. On blade rows with running gap, this leads to re-flow phenomena and the occurrence of instability of the machine at higher loads.

Fluid flow machines according to the state of the art either have no particular features to provide remedy in this area, or so-called casing treatments are used as counter-measure, which include a) slots/apertures and chambers in the casing above the rotor,
b) slots in the casing, which are essentially oriented in flow direction and have a slender form with a small extension, as viewed in the circumferential direction of the machine,
c) circumferential grooves of different cross-sectional shapes.

This includes known solutions, which are disclosed in the following documents:

US 2005/0226717 A1
EP 0 754 864 A1
DE 101 35 003 C1
DE 103 30 084 A1

A sketch of conventional slots and grooves 10 is provided in FIGS. 1*a* and 1*b*.

Simple concepts of casing treatments, as known from the state of the art, in the form of slots and/or chambers in the annulus duct wall provide for an increase in stability of the fluid flow machine. However, due to unfavorably selected arrangement or shaping, this increase in stability is unavoidably accompanied by a loss in efficiency. The known solutions partly consume much space at the periphery of the annulus duct of the fluid flow machine and, due to their shape have only limited efficiency and/or are restricted to an arrangement of a rotor blade row enclosed by a casing.

A broad aspect of the present invention is to provide a fluid flow machine of the type specified above which, while avoiding the disadvantages of the state of the art, is characterized by exerting a highly effective influence on the boundary layer in the blade tip area.

More particularly, the present invention relates to a blade row of a fluid flow machine with free blade end and running gap, with at least part of the running gap retracting from the main flow path confinement into the main flow path by a finite amount, with the running gap at the retractions no longer being confined by the main flow path confinement, but by a peripheral guiding device passed by the main flow and connected to the main flow path confinement and including a row of straight or cambered profiles. The running gap retraction according to the present invention applies to arrangements with running gap and relative movement between blade end and main flow path confinement, both on the casing and on the hub of the fluid flow machine.

The present invention therefore relates to fluid flow machines, such as blowers, compressors, pumps and fans of the axial, semi-axial and radial type. The working medium or fluid may be gaseous or liquid.

The fluid flow machine may include one or several stages, each stage having a rotor and a stator; in individual cases, the stage is formed by a rotor only.

The rotor includes a number of blades, which are connected to the rotating shaft of the machine and impart energy to the working medium. The rotor may be designed with or without shrouds at the outward blade ends.

The stator includes a number of stationary vanes, which may either feature a fixed or a free blade end on the hub and on the casing side.

Rotor drum and blading are usually enclosed by a casing; in other cases (e.g. aircraft or ship propellers) no such casing exists.

The machine may also feature a stator, a so-called inlet guide vane assembly, upstream of the first rotor. Departing from the stationary fixation, at least one stator or inlet guide vane assembly may be rotatably borne, to change the angle of attack. Variation is accomplished for example via a spindle accessible from the outside of the annulus duct.

In a special configuration the fluid flow machine may have at least one row of variable rotors.

In an alternative configuration, multi-stage types of fluid flow machines according to the present invention may have two counter-rotating shafts, with the direction of rotation of the rotor blade rows alternating between stages. Here, no stators exist between subsequent rotors.

Finally, the fluid flow machine may—alternatively—feature a bypass configuration such that the single-flow annulus duct divides into two concentric annuli behind a certain blade row, with each of these annuli housing at least one further blade row.

FIG. 2 (Prior Art) shows examples of fluid flow machines relevant to the present invention.

Figure 4A:
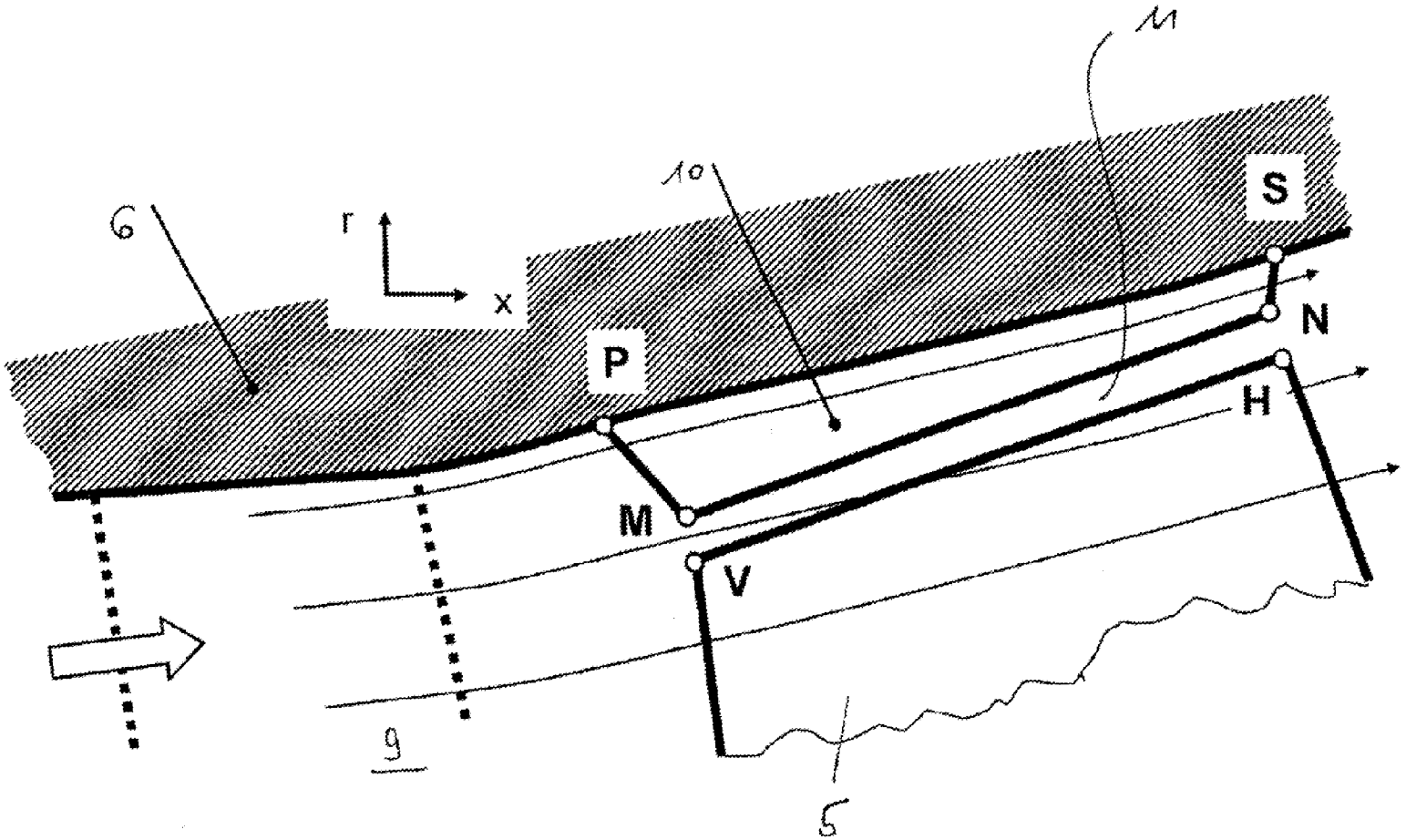
Figure 4B:
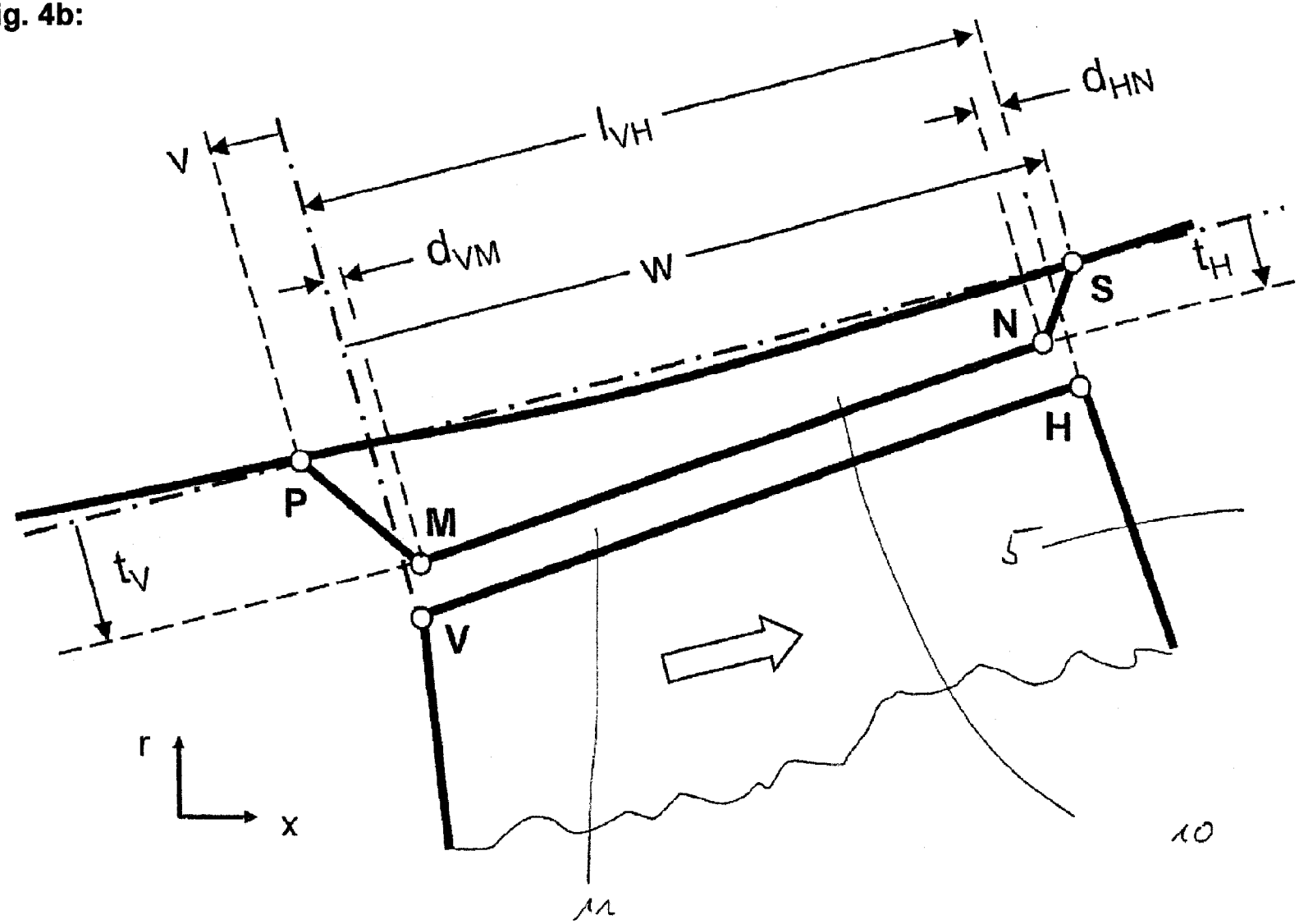
Figure 5B:
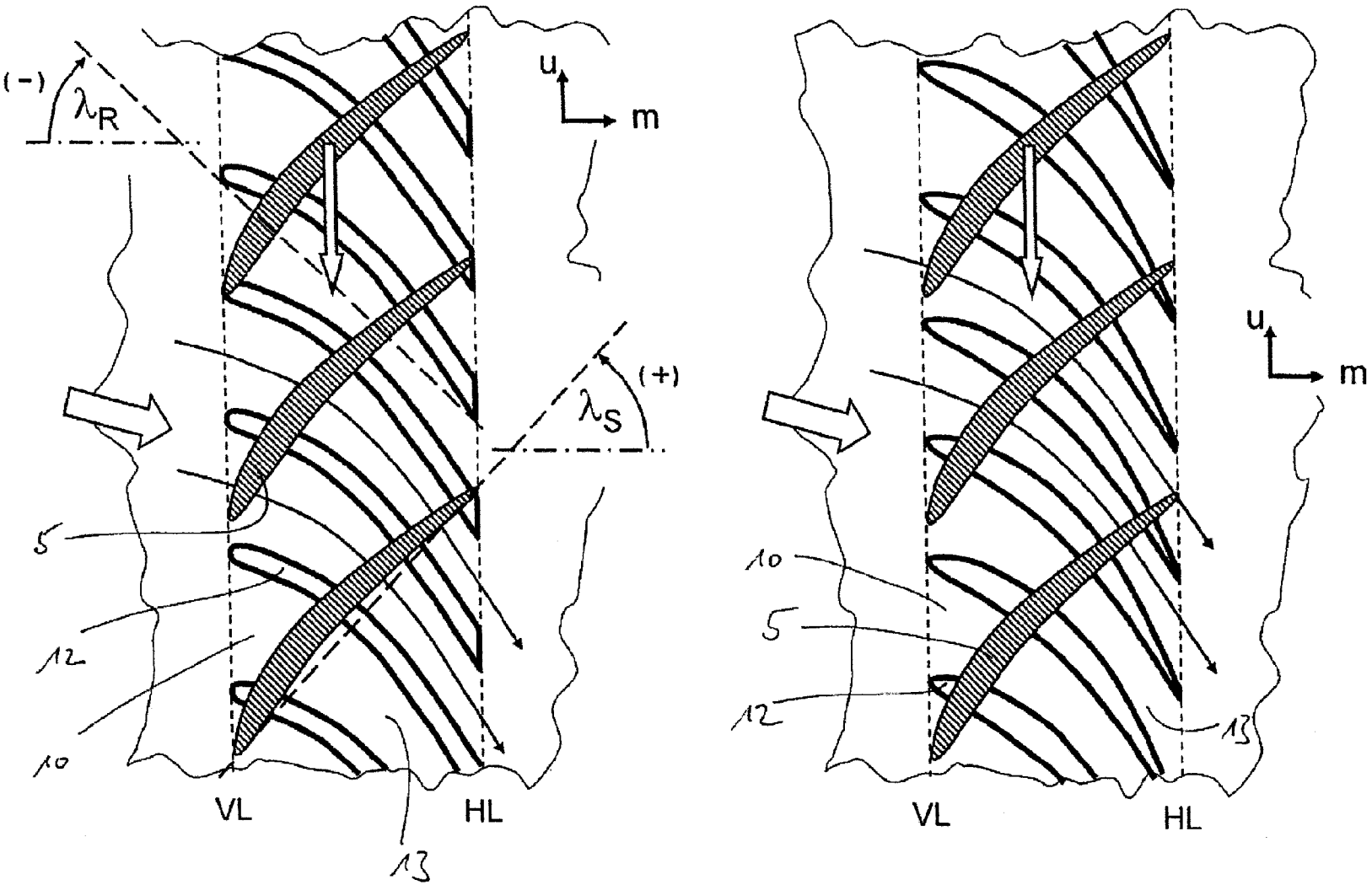
Figure 7C:
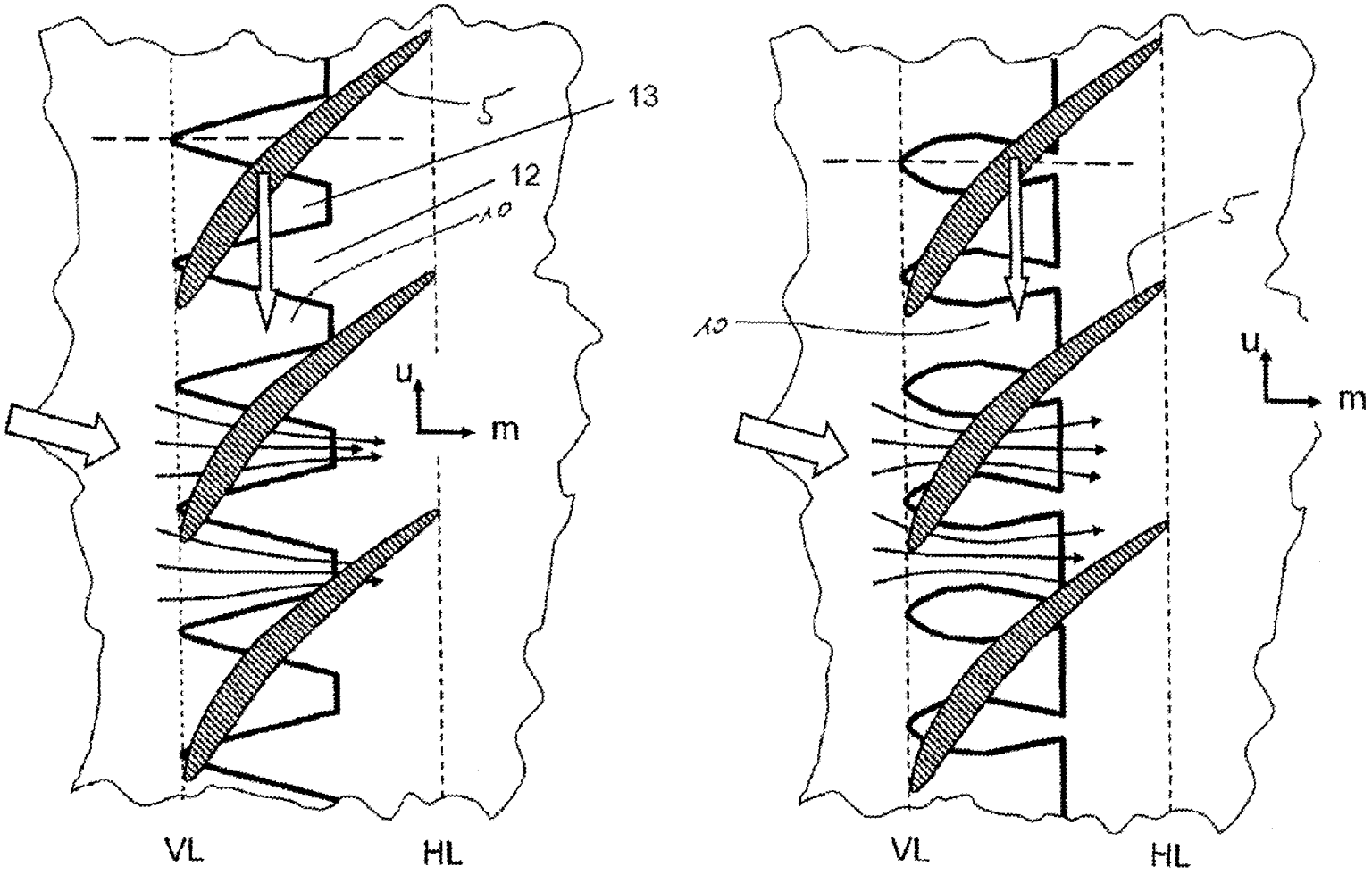
Figure 10:
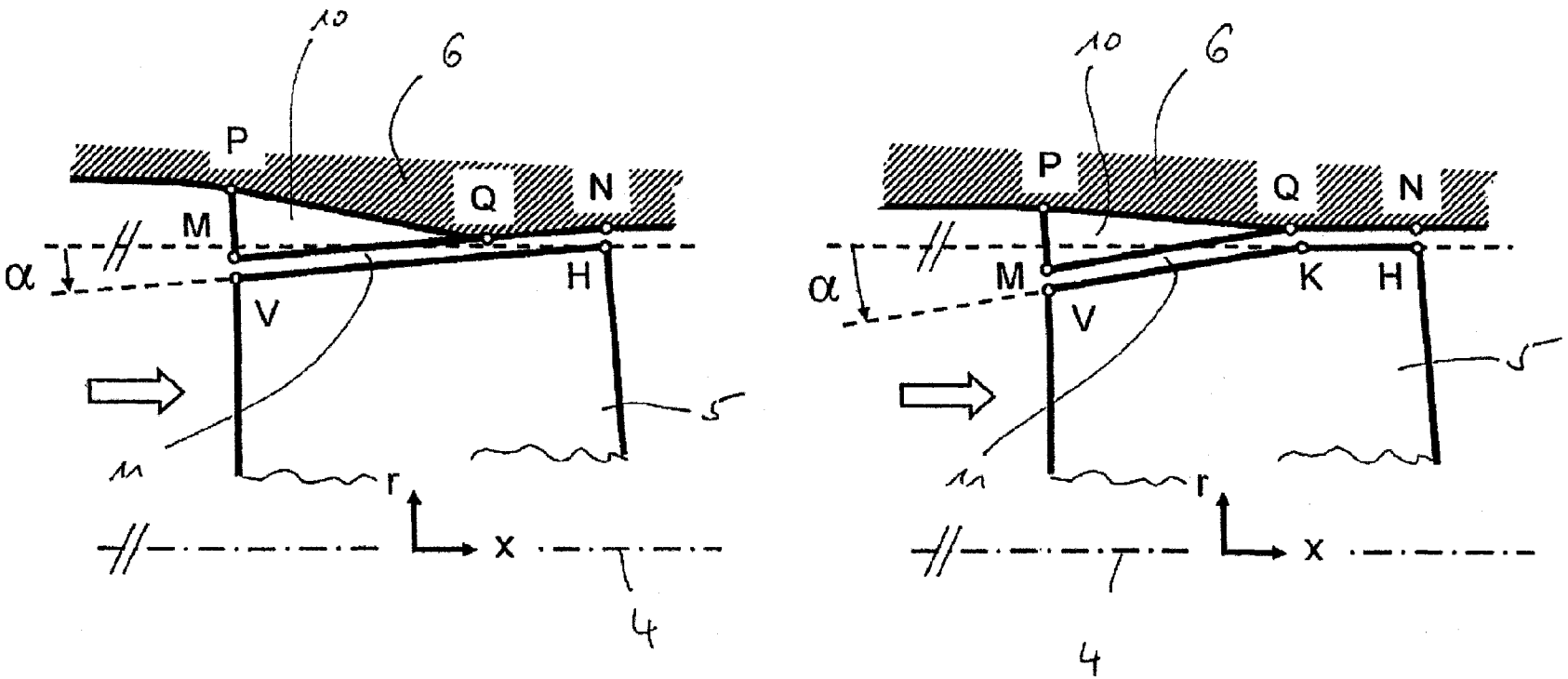
Figure 11:
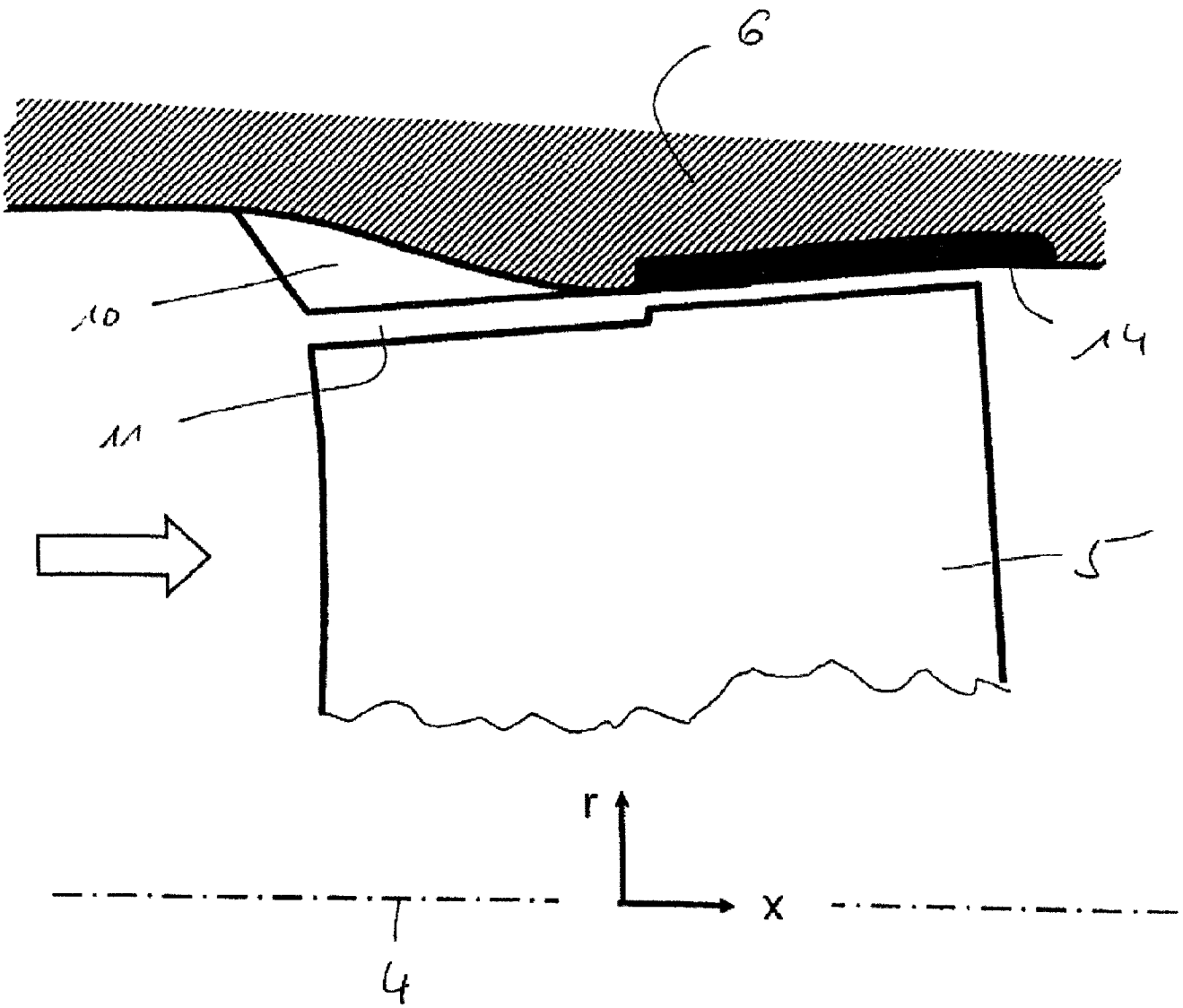
Figure 12:
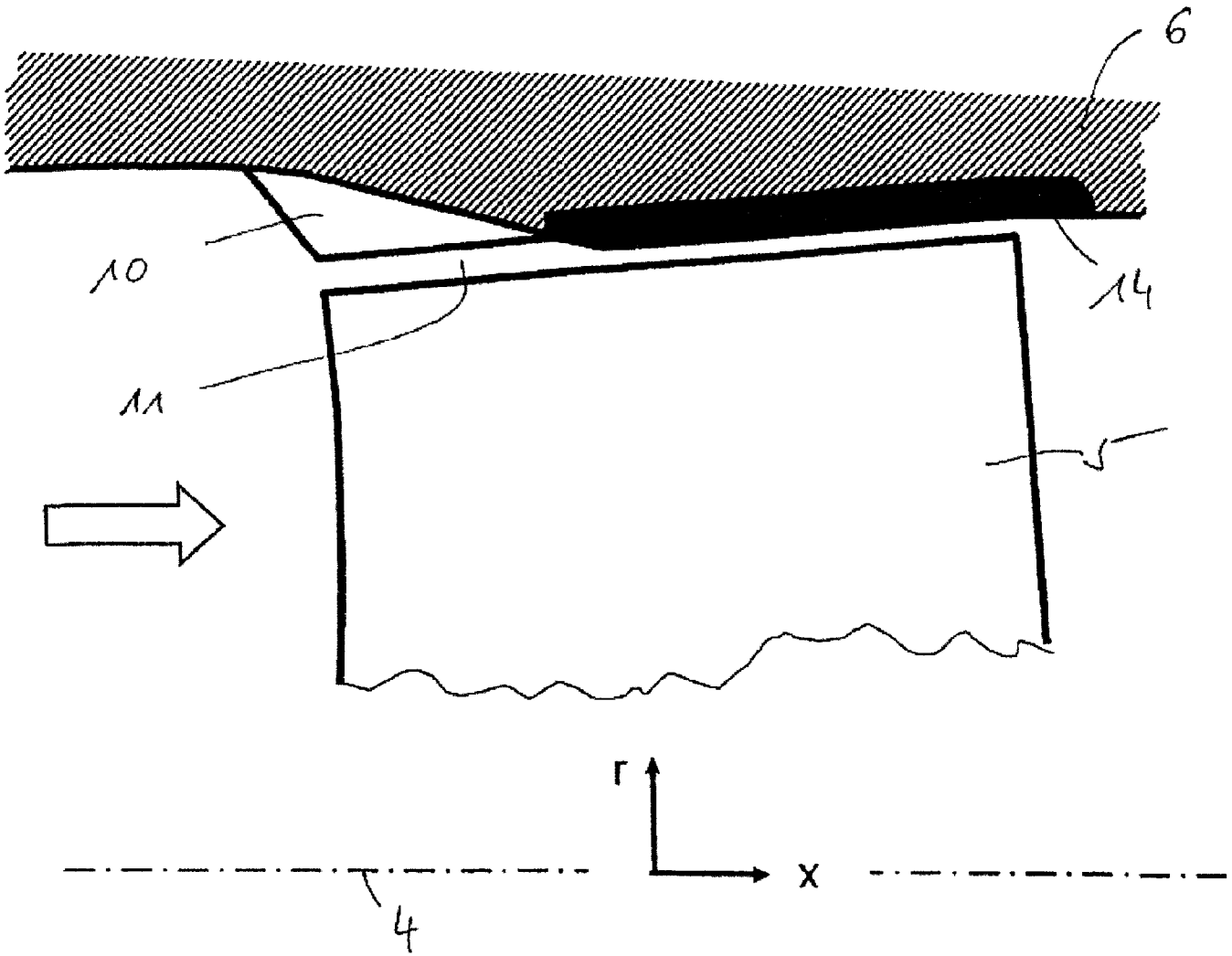

The present invention is more fully described in light of the accompanying figures showing preferred embodiments:

FIG. 1*a* is a sketch of the state of the art, rotor casing treatment,

FIG. 1*b* is a sketch of the state of the art, rotor casing, circumferential grooves, FIG. 2 (Prior Art) shows examples of fluid flow machines relevant to the present invention, FIG. 3 shows a running gap arrangement in accordance with the state of the art in meridional section, FIG. 4*a* shows an example of a running gap arrangement in meridional section in accordance with the present invention, FIG. 4*b* shows a definition of relevant characteristics of the arrangement in accordance with the present invention, FIG. 5*a* shows running gap arrangements in accordance with the present invention, FIG. 5*b* shows arrangements of the peripheral guiding device in accordance with the present invention, view Z-Z of FIG. 5*a*, FIG. 6 shows running gap arrangements in accordance with the present invention, FIG. 7*a* shows running gap arrangements in accordance with the present invention, FIG. 7*b* shows arrangements of the peripheral guiding device in accordance with the present invention, view Z-Z of FIG. 7*a*, FIG. 7*c* shows arrangements of the peripheral guiding device in accordance with the present invention, view Z-Z of FIG. 7*a*, FIG. 8 shows a running gap arrangement in accordance with the present invention, FIG. 9 shows a running gap arrangement in accordance with the present invention, FIG. 10 shows running gap arrangements in accordance with the present invention in meridional section, definition of running gap inclination, FIG. 11 shows running gap arrangements in accordance with the present invention with abradable coating and step at the blade tip, FIG. 12 shows running gap arrangements in accordance with the present invention with abradable coating and step at the peripheral guiding device.

FIG. 3 shows a state-of-the-art gap arrangement in the area of the blade end of a blade row 5 of a fluid flow machine in the meridional plane established by the axial direction x and the radial direction r. The running gap 11 at the tip of the free blade end is situated directly at the periphery of the main flow path 2 formed by a hub or casing assembly 6. Consequently, in the state of the art, the gap 11 is, on the one side, formed by the inner or outer annulus duct contour (hub or casing 6) of the fluid flow machine and, on the other side, by the tip of a rotor blade or a stator vane.

A rotary relative movement exists between the blade tip and the component assembly forming the main flow path confinement (annulus duct contour 2). This representation and any other illustration of the present invention therefore similarly applies to the following arrangements:

1) Rotary blade (rotor) on stationary casing,
2) Stationary blade (stator) on rotary hub,
3) Stationary blade (stator) on rotary casing,
4) Rotary blade (rotor) on stationary hub.

The main flow direction is indicated by a bold arrow. Upstream of the blade row 5 with running gap at least one further blade row 5 can be disposed, as indicated here by broken lines. Also downstream (not indicated in the sketch) at least one further blade row can be arranged. Three thin, long arrows indicate the meridional flow in the vicinity of the main flow path confinement. It passes through the blade row 5 essentially parallel to the blade tip and parallel to the running gap. The running gap 11, in an arrangement according to the state of the art, is marked by four end points:

1) the leading edge point V at the blade tip,
2) the trailing edge point H at the blade tip,
3) the forward gap end point M arranged opposite of the leading edge point V,
4) the rearward gap end point N arranged opposite of the trailing edge point H.

According to the state of the art, the lines between the points V and H and between the points M and N can have a straight or a curved course.

FIG. 4 shows, in similar representation, an example of a gap arrangement according to the present invention in the area of the blade end of a blade row of a fluid flow machine in the meridional plane established by the axial direction x and the radial direction r. The running gap 11 at the tip of the free blade end is remote from the main flow path confinement by a finite distance.

Different distances of the running gap 11 to the main flow path confinement at the leading edge and at the trailing edge lead to an inclination of the running gap against the main flow path confinement and also against the meridional flow.

Retraction of the running gap 11 into the interior of the main flow path according to the present invention and, if applicable, inclination of the running gap according to the present invention, leads to reduction of the gap leakage flow and, in particular, suppression of a meridional reflow in the area of the running gap.

A peripheral guiding device 10 including of a row of straight or cambered profiles is provided in the space produced between the running gap 11 and the main flow path confinement by the retraction of the running gap 11. The peripheral guiding device 10 is firmly connected to the component assembly forming the main flow path confinement.

The representation in FIG. 4 shows a variant according to the present invention with gap retraction at leading and trailing edge and, consequently, a peripheral guiding device 10 extending from the leading edge to the trailing edge. The running gap arrangement is here marked by six points:

1) the leading edge point V at the blade tip,
2) the trailing edge point H at the blade tip,
3) the forward gap end point M arranged opposite of the leading edge point V,
4) the rearward gap end point N arranged opposite of the trailing edge point H,
5) the forward contour point P of the main flow path confinement delimiting the peripheral guiding device in the upstream direction,
6) the rearward contour point S of the main flow path confinement delimiting the peripheral guiding device 10 in the downstream direction.

According to the present invention, the lines between the points V and H and between the points M and N as well as between the points P and S can have a straight (as shown in FIG. 4) or a curved/bent course.

FIG. 4*b* shows the definition of relevant characteristics of the running gap arrangement according to the present invention. The retraction depth of the running gap 11 is variable according to the present invention. Definition of the characteristics is by a reference line through the points P and S of the main flow path confinement if the peripheral guiding device is provided to or beyond the trailing edge of the blade row in the direction of flow. If the peripheral guiding device 10 ends already upstream of the trailing edge of the blade row 5, with point N falling on the main flow path confinement, the reference line is defined by the points P and N. The running gap retraction depth at the leading edge, $t_V$, is defined as the distance of the forward gap end point M from the main flow path confinement, measured in vertical direction to the reference line.

The running gap retraction depth at the trailing edge, $t_H$, is defined as the distance of the rearward gap end point N from the main flow path confinement, measured in vertical direction to the reference line.

The length of the blade tip, $l_{VH}$, is defined as the vertical distance of the trailing edge point H from the orthogonal to the reference line passing through the leading edge point V. The leading edge offset $d_{VM}$ is defined as the vertical distance of the gap end point M from the orthogonal to the reference line passing through the leading edge point V.

The trailing edge offset $d_{HN}$ is defined as the vertical distance of the gap end point N from the orthogonal to the reference line passing through the trailing edge point H.

The upstream extension of the peripheral guiding device, v, is defined as the vertical distance of the contour point P of the main flow path confinement from the orthogonal to the reference line passing through the leading edge point V and is positive, as shown. The downstream extension of the peripheral guiding device, w, is defined as the vertical distance of the contour point S of the main flow path confinement from the orthogonal to the reference line passing through the leading edge point V and is positive, as shown.

In accordance with the present invention, the following restrictions shall apply:

1) $t_V < 0.3 \cdot l_{VH}$
2) $t_H < 0.3 \cdot l_{VH}$
3) $-0.05 \cdot VH < d_{VM} < 0.05 \cdot l_{VH}$
4) $-0.1 \cdot l_{VH} < d_{HN} < 0.1 \cdot l_{VH}$ 5) $-0.05 \cdot l_{VH} < v < l_{VH}$ 6) $0 < w < 1.1 \cdot l_{VH}$ The running gap retraction depth at any point within the bladed area (between leading and trailing edge) of the blade row 5 is defined as the distance of the respective point from the main flow path confinement, measured in vertical direction to the reference line.

FIG. 5*a* shows two running gap arrangements according to the present invention in which the peripheral guiding device 10 extends along the entire blade tip. The left-hand half of the figure (meridional section, x-r plane) shows, at the top, a variant with rectilinear course of the main flow path confinement and, at the bottom, a variant with curved course of the main flow path confinement. In both variants, the retraction depth of the running gap is larger at the leading edge than at the trailing edge ($t_V > t_H$).

View Z-Z is shown in both variants.

On the right-hand side of the figure, the configuration is shown in View Z-Z, i.e. in the plane established by the meridional direction m and the circumferential direction u. The sectional plane Z-Z extends within the main flow path through the blades 5 there disposed, three of which are depicted in the cut-out shown. Also visible is the peripheral guiding device 10, which here includes a row of slender, straight profiles 12. The peripheral guiding device 10 is firmly connected to the main flow path confinement. The blades 5 of the blade row perform, as indicated by the slender arrow showing in the circumferential direction u, a (rotary) relative movement against the peripheral guiding device 10 and the main flow path confinement. The main flow passes the arrangement from the left to the right, see the bold arrow. The flow through two adjacent passages of the peripheral guiding device 10 is indicated by a thin arrow each. The profiles and the passages of the peripheral guiding device 10 are straight in this example. The connecting line of the leading edge points V of the blades is marked VL and the connecting line of the trailing edge points H of the blades is marked HL. Situated between VL and HL is the bladed area of the blade row 5 which, in the example according to the present invention here shown, essentially agrees with the area covered by the peripheral guiding device 10.

Also falling within the scope of the present invention, two further arrangements of the peripheral guiding device 10 are shown in FIG. 5*b* in the View Z-Z known from FIG. 5*a*. Turning to the left-hand side of the Figure, the peripheral guiding device 10 includes a row of cambered profiles 12 of constant thickness. The passage between two profiles 12 of the peripheral guiding device 10 is markedly curved such that the circumferential component of the flow, when passing the peripheral guiding device 10, increases in the direction of the relative movement of the blade row 5. The stagger angle $\lambda_R$ of the profiles of the peripheral guiding device 10 and the stagger angle $\lambda_S$ of the profiles of the blade row 5 here have opposite signs. The stagger angle is measured between the meridional direction m and the chord line of the respective profile 12. The stagger angle $\lambda_R$ of the profiles of the peripheral guiding device 10 is negatively signed in the direction shown. The stagger angle $\lambda_S$ of the profiles of the blade row 5 is positively signed in the direction shown. If the profiles have no camber and a non-constant thickness, the longitudinal symmetry line of the profile, instead of the profile chord, is used for determining the stagger angle.

A quite similar configuration is shown in the right-hand half of the figure. Shown there is a peripheral guiding device with cambered and drop-shaped profiles.

FIG. 6 shows two running gap arrangements according to the present invention in which the peripheral guiding device 10 extends along the entire blade tip, but with the retraction depth of the running gap 11 decreasing to zero up to the trailing edge of the blade row 5 (tV>tH=0). The rearward gap end point N of the peripheral guiding device here coincides with the rearward contour point S of the main flow path confinement. Thus, the peripheral guiding device 10 is, in meridional section, provided with a favorable wedge-type shape in accordance with the present invention.

The right-hand side of the figure shows the View Z-Z in the plane established by the meridional direction m and the circumferential direction u. Here, the profiles 12 and the passages 13 of the peripheral guiding device 10 are again straight, with the area occupied by the peripheral guiding device 10 coinciding essentially with the bladed area of the blade row 5 (between VL and HL).

The stagger angle $\lambda_R$ of the profiles of the peripheral guiding device and the stagger angle $\lambda_S$ of the profiles of the blade row here have equal signs.

According to the present invention, the stagger angle of the profiles of the peripheral guiding device may have values in the range between −70° and 70° ($-70° < \lambda_R < 70°$), but it is particularly favorable to provide values from the range $-40° < \lambda_R < 30°$.

FIG. 7*a* shows two running gap arrangements in accordance with the present invention, in which the peripheral guiding device 10 extends over the forward part of the blade tip. While the rearward gap end point N now lies on the main flow path confinement, the contour point S is situated within the bladed area of the blade row 5. The retraction depth of the running gap 11 decreases to zero up to the point S. Accordingly, the gap retraction depth is continuously zero between the contour point S and the rearward gap end point N. Here again, the peripheral guiding device 10 has, in meridional section, a favorable wedge-type shape in accordance with the present invention.

The left-hand side of the figure shows, at the top, an arrangement according to the present invention in which the main flow path confinement extends approximately rectilinearly and, due to the wedge-type shape of the peripheral guiding device 10, a bending point K is provided in the blade tip near the contour point S. Accordingly, the running gap also extends with a bend.

The bottom left-hand part of the figure shows an arrangement according to the present invention in which the main flow path confinement has a curved extension such that, despite the wedge-type shape of the peripheral guiding device 10, a bend-free course of the blade tip and the running gap 11 can be provided.

The right-hand side of the figure shows the View Z-Z in the plane established by the meridional direction m and the circumferential direction u. Here, the profiles and the passages of the peripheral guiding device 10 are curved, with the area occupied by the peripheral guiding device 10, commencing at the leading edge line VL, covering only part of the bladed area of the blade row 5. The stagger angle $\lambda_R$ of the profiles of the peripheral guiding device 10 and the stagger angle $\lambda_S$ of the profiles of the blade row 5 here have opposite signs.

Also falling within the scope of the present invention, two further arrangements of the peripheral guiding device 10 are shown in FIG. 7*b* in the View Z-Z known from FIG. 7*a*. Turning to the left-hand side of the figure, the peripheral guiding device 10 includes a row of non-cambered profiles of constant thickness. Turning to the right-hand side of the figure, the peripheral guiding device 10 includes a row of cambered profiles of constant thickness. The passage between two profiles of the peripheral guiding device 10 is curved such that the circumferential component of the flow, when passing the peripheral guiding device 10, increases opposite to the direction of the relative movement of the blade row 5.

Also falling within the scope of the present invention, two further arrangements of the peripheral guiding device 10 are shown in FIG. 7*c* in the View Z-Z known from FIG. 7*a*. Turning to the left-hand side of the figure, the peripheral guiding device includes a row of non-cambered wedge-type profiles with maximum thickness at the trailing edge. The displacement effect here continuously increases in the direction of flow. Turning to the right-hand side of the figure, the peripheral guiding device 10 includes a row of non-cambered, thick profiles with maximum displacement effect in the center part thereof. In both halves of the figure, the longitudinal symmetry axis is marked for a profile of the peripheral guiding device 10, and is to be used for determining the stagger angle for this type of profile.

FIG. 8 shows a favorable running gap arrangement according to the present invention in which, in the meridional section (x-r plane), the peripheral guiding device 10 extends only along the forward third of the blade tip according to the following provision w<0.33 lVH. The right-hand side of the figure shows the View Z-Z in the plane established by the meridional direction m and the circumferential direction u. Here, the profiles and the passages of the peripheral guiding device 10 are of short and straight design.

FIG. 9 shows another favorable running gap arrangement according to the present invention. As shown in the left-hand half of the figure in the meridional section (x-r plane), the running gap extends parallel to the machine axis.

Furthermore, the forward contour point P of the main flow path confinement is disposed significantly upstream of the forward gap end point M, resulting in a distinct upstream extension of the peripheral guiding device 10, v, of approximately $0.4 \cdot l_{VH}$. In consequence thereof, the leading edge of the peripheral guiding device profiles no longer extends essentially orthogonally to the running gap or to the main flow path confinement, as in the above solutions according to the present invention, but (corresponding to an aerodynamic sweep) obliquely to the running gap and obliquely to the main flow path confinement. The right-hand side of the figure shows the View Z-Z as known. Here, the profiles and the passages of the peripheral guiding device 10 are curved. As a result of the aerodynamic sweep provided, the peripheral guiding device 10 occupies an area upstream of the leading edge line VL and a part of the bladed area of the blade row 5.

FIG. 10 shows further favorable running gap arrangements according to the present invention with low gap inclination angle. The gap inclination angle $\alpha$ is measured between the longitudinal axis of the fluid flow machine and a straight line passing through the points V and H if the blade tip has no bent, see left-hand half of the figure. The gap inclination angle $\alpha$ is measured between the longitudinal axis of the fluid flow machine and a straight line passing through the points V and K if the blade tip has a bending point K, see right-hand half of the figure $\alpha$ is positive, as shown.

According to the present invention, it is particularly favorable if the gap inclination angle amounts to less than 8° ($-8° < \alpha < 8°$).

In FIG. 11, a gap arrangement according to the present invention is shown, with a peripheral guiding device 10 being arranged in the forward area of the blade row 5 and, following in flow direction, an abradable coating 14 being provided in the rearward part of the bladed area of blade row 5. With such an arrangement, it may be favorable according to the present invention to provide the blade tip with a step, such that the running gap is larger in the area of the peripheral guiding device 10 than in the area of the abradable coating 14.

In FIG. 12, a gap arrangement according to the present invention is again shown, with a peripheral guiding device 10 being arranged in the forward area of the blade row and, following in flow direction, an abradable coating 14 being provided in the rearward part of the bladed area of blade row 5. With such an arrangement, alternatively to a step provided in the blade tip, it may be favorable according to the present invention to somewhat recess the peripheral guiding device 10 against the abradable coating 14, such that the running gap 11 is larger in the area of the peripheral guiding device 10 than in the area of the abradable coating 14.

The present invention can be described as follows:

Fluid flow machine with a main flow path which is confined by a hub and a casing and in which at least one row of blades is arranged, with a blade end with gap being provided on the blade row, with the blade end and the main flow path confinement performing a rotary movement relative to each other in the vicinity of said blade end, with at least part of the running gap retracting from the main flow path confinement into the main flow path by a finite amount, with the running gap at the retractions no longer being confined by the main flow path confinement, but by a peripheral guiding device passed by the main flow and firmly connected to the main flow path confinement and consisting of a row of profiles, with preferably the configuration of the peripheral guiding device and of the running gap, as viewed in meridional section, being subject to further restrictions with regard to six significant characteristics, with a) $l_{HV}$ being the length between the leading edge and the trailing edge at the blade tip, b) the running gap retraction depth at the leading edge, $t_V$, being subject to the requirement $t_V < 0.3 \cdot l_{VH}$, c) the running gap retraction depth at the trailing edge, $t_H$, being subject to the requirement $t_H < 0.3 \cdot l_{VH}$, d) the leading edge offset $d_{VM}$ being subject to: $-0.05 \cdot l_{VH} < d_{VM} < 0.05 \cdot l_{VH}$, e) the trailing edge offset $d_{HN}$ being subject to: $-0.1 \cdot l_{VH} < d_{HN} < 0.1 \cdot l_{VH}$, f) the upstream extension of the peripheral guiding device, v, being subject to the requirement $0.05 \cdot l_{VH} < v < l_{VH}$, g) the downstream extension of the peripheral guiding device, w, being subject to the requirement $0 < w < 1.1\, l_{VH}$, with preferably the running gap retraction depth at the leading edge, $t_V$, being larger than the running gap retraction depth at the trailing edge, $t_H$, so that the running gap, at least in a partial section, is inclined against the main flow path confinement and also against the meridional flow, thereby reducing the gap leakage flow, with preferably the running gap retraction depth continuously decreasing to zero up to the trailing edge of the blade row, so that the peripheral guiding device has a wedge-type shape in meridional section, with preferably the running gap retraction depth continuously decreasing to zero up to a point upstream of the trailing edge and within the bladed area of the blade row, so that the peripheral guiding device has a wedge-type shape in meridional section, with preferably the downstream extension of the peripheral guiding device, w, being confined to max. the forward third of the blade tip according to the requirement $w < 0.33\, l_{VH}$, with preferably the main flow path confinement extending essentially smoothly and, consequently, a bending point being provided in the blade tip and in the running gap while maintaining the wedge-type shape of the peripheral guiding device, with preferably the main flow path confinement being S-shaped and a rectilinear course of the blade tip and the running gap being provided while maintaining the wedge-type shape of the peripheral guiding device, with preferably an inclination angle of the running gap amounting to less than 8° being provided ($-8° < \alpha < 8°$), with preferably an upstream extension of the peripheral guiding device, v, greater than $0.25 \cdot l_{VH}$ being provided, thereby orienting the leading edge of the peripheral guiding device profiles obliquely to the running gap and obliquely to the main flow path confinement corresponding to an aerodynamic sweep, with preferably the profiles of the peripheral guiding device not being cambered, with preferably the profiles of the peripheral guiding device being cambered, with preferably a stagger angle $\lambda_R$ of the profiles of the peripheral guiding device being provided with a value in the range $-40° < \lambda_R < 30°$, with preferably the stagger angle $\lambda_R$ of the profiles of the peripheral guiding device and the stagger angle $\lambda_S$ of the profiles of the blade row having opposite signs, with preferably the stagger angle $\lambda_R$ of the profiles of the peripheral guiding device and the stagger angle $\lambda_S$ of the profiles of the blade row having equal signs, with preferably the profiles of the peripheral guiding device featuring a wedge-type shape with maximum thickness at their trailing edge, with preferably in the rearward part of the bladed area of the blade row an abradable coating being provided and the blade tip being provided with a step such that the running gap in the area of the peripheral guiding device is larger than in the area of the abradable coating, with preferably in the rearward part of the bladed area of the blade row an abradable coating being provided and the peripheral guiding device being somewhat recessed against the abradable coating such that the running gap in the area of the peripheral guiding device is larger than in the area of the abradable coating.

The present invention provides for a significantly higher aerodynamic loadability of rotors and stators in fluid flow machines, with efficiency being maintained or even improved. A reduction of the number of parts and the weight of the components by more than 20 percent is achievable. Application of the concept to the high-pressure compressor of an aircraft engine with approx. 25.000 lbs thrust leads to a reduction of the specific fuel consumption of up to 0.5 percent.

LIST OF REFERENCE NUMERALS

1 Casing
2 Annulus duct/main flow path
3 Rotor drum (hub)
4 Machine axis
5 Blade/blade row
6 Hub or casing assembly
7 Annular groove/(upstreamly oriented) groove
9 Upstream blading (optional)
10 Row of profiles (straight or cambered), peripheral guiding device
11 Gap/running gap
12 Profiles of 10
13 Passage
14 Abradable coating

What is claimed is:

1. A fluid flow machine, comprising:

a hub;

a casing;

a main flow path which is confined by the hub and casing;

at least one row of blades arranged in the main flow path;

a blade tip provided on the blade row, with the blade tip and the main flow path confinement performing a rotary movement relative to each other in a vicinity of the blade tip;

a peripheral guiding device connected to the main flow path confinement and extending into the main flow path, the peripheral guiding device including a row of profiles extending from the main flow path confinement into the main flow path;

a running gap positioned between the blade tip and the peripheral guiding device, with at least a portion of the running gap being retracted from the main flow path confinement;

wherein a running gap retraction depth at a leading edge of the blade tip, $t_V$, is larger than a running gap retraction depth at a trailing edge of the blade tip, $t_H$, and that the running gap, at least in a partial section, is inclined against the main flow path confinement and against the meridional flow;

wherein the running gap retraction depth continuously decreases from a forward gap endpoint of the peripheral guiding device to zero up to a point upstream of the trailing edge and within a bladed area of the blade row, and the peripheral guiding device has a wedge-type shape in meridional section;

wherein a configuration of the peripheral guiding device and of the running gap, as referred to a meridional section of the fluid flow machine, is defined by the following characteristics:

a) $l_{VH}$ is a length between the leading edge and the trailing edge at the blade tip, b) the running gap retraction depth from the main flow path confinement at the leading edge, $t_V$, is subject to a requirement $t_V < 0.3 \cdot l_{VH}$, c) the running gap retraction depth from the main flow path confinement at the trailing edge, $t_H$, is subject to a requirement $t_H < 0.3 \cdot l_{VH}$, d) a leading edge offset at the running gap between the blade tip and the peripheral guiding device at the running gap, $d_{VM}$, is subject to: $-0.05 \cdot l_{VH} < d_{VM} < 0.5 \cdot l_{VH}$, e) a trailing edge offset at the running gap between the blade tip and the peripheral guiding device at the running gap, $d_{HN}$, is subject to: $-0.1 \cdot l_{VH} < d_{HN} < 0.1 \cdot l_{VH}$, f) an upstream extension of the peripheral guiding device with respect to the leading edge of the blade tip, v, is subject to a requirement $0.05 \cdot l_{VH} < v < l_{VH}$, g) a downstream extension of the peripheral guiding device with respect to the leading edge of the blade tip, w, is subject to a requirement $0 < w < 1.1\ l_{VH}$.

2. The fluid flow machine of claim 1, wherein leading edges of the profiles are directly exposed to a main flow in the main flow path with the main flow passing between the profiles.

3. The fluid flow machine of claim 2, wherein the main flow path confinement has a smooth continuous surface extending between at least two adjacent ones of the profiles from a position separated upstream of the profiles to a position separated downstream of the profiles.

4. The fluid flow machine of claim 1, wherein the peripheral guiding device extends along an entire length of the blade tip and the running gap retraction depth continuously decreases from a forward gap endpoint of the peripheral guiding device to zero up to the trailing edge of the blade row.

5. A fluid flow machine, comprising:

a hub;

a casing;

a main flow path which is confined by the hub and casing;

at least one row of blades arranged in the main flow path;

a blade tip provided on the blade row, with the blade tip and the main flow path confinement performing a rotary movement relative to each other in a vicinity of the blade tip;

a peripheral guiding device connected to the main flow path confinement and extending into the main flow path, the peripheral guiding device including a row of profiles extending from the main flow path confinement into the main flow path;

a running gap positioned between the blade tip and the peripheral guiding device, with at least a portion of the running gap being retracted from the main flow path confinement;

wherein a running gap retraction depth at a leading edge of the blade tip, $t_V$, is larger than a running gap retraction depth at a trailing edge of the blade tip, $t_H$, and that the running gap, at least in a partial section, is inclined against the main flow path confinement and against the meridional flow;

wherein the peripheral guiding device extends along an entire length of the blade tip and the running gap retraction depth continuously decreases from a forward gap endpoint of the peripheral guiding device to zero up to the trailing edge of the blade row.

6. The fluid flow machine of claim 5, wherein a downstream extension of the peripheral guiding device, w, is confined to a maximum of a forward third of the blade tip according to a requirement $w<0.33\ I_{VH}$, where $I_{VH}$ is a length between the leading edge and the trailing edge at the blade tip.

7. The fluid flow machine of claim 5, wherein the main flow path confinement extends essentially smoothly and the wedge-type shape of the peripheral guiding device results in a bending point on the blade tip and in the running gap.

8. The fluid flow machine of claim 5, wherein the main flow path confinement is S-shaped and the wedge-type shape of the peripheral guiding device results in a straight course of the blade tip and the running gap from the leading edge of the blade tip to the trailing edge of the blade tip.

9. The fluid flow machine of claim 5, wherein an inclination angle $\alpha$ of the running gap falls within: $-8°<\alpha<8°$.

10. The fluid flow machine of claim 5, wherein the running gap is provided parallel to a machine axis.

11. The fluid flow machine of claim 5, wherein the peripheral guiding device includes an upstream extension, v, greater than $0.25 \cdot I_{VH}$, and the leading edges of the peripheral guiding device profiles correspond to an aerodynamic sweep and are oriented obliquely to the running gap and obliquely to the main flow path confinement.

12. The fluid flow machine of claim 5, wherein the profiles of the peripheral guiding device are free of camber.

13. The fluid flow machine of claim 5, wherein the profiles of the peripheral guiding device are cambered in their longitudinal extension.

14. The fluid flow machine of claim 5, wherein a stagger angle of the profiles of the peripheral guiding device, $\lambda_R$, is within a range $-40°<\lambda_R<30°$.

15. The fluid flow machine of claim 5, wherein a stagger angle $\lambda_R$ of the profiles of the peripheral guiding device and a stagger angle $\lambda_S$ of profiles of the blade row have opposite signs.

16. The fluid flow machine of claim 5, wherein a stagger angle $\lambda_R$ of the profiles of the peripheral guiding device and a stagger angle $\lambda_S$ of profiles of the blade row have equal signs.

17. The fluid flow machine of claim 5, wherein the profiles of the peripheral guiding device in a circumferential direction of the fluid flow machine have a wedge-type shape with maximum thickness at their trailing edge.

18. The fluid flow machine of claim 5, wherein an abradable coating in positioned at a rearward part of the bladed area of the blade row and the blade tip includes a step, with the running gap in an area of the peripheral guiding device being larger than in an area of the abradable coating.

19. The fluid flow machine of claim 5, wherein an abradable coating in positioned at a rearward part of the bladed area of the blade row and the peripheral guiding device is recessed against the abradable coating in a radial direction, with the running gap in an area of the peripheral guiding device being larger than in an area of the abradable coating.

20. The fluid flow machine of claim 5, wherein leading edges of the profiles are directly exposed to a main flow in the main flow path with the main flow passing between the profiles.

21. The fluid flow machine of claim 20, wherein the main flow path confinement has a smooth continuous surface extending between at least two adjacent ones of the profiles from a position separated upstream of the profiles to a position separated downstream of the profiles.

22. A fluid flow machine, comprising:

a hub;

a casing;

a main flow path which is confined by the hub and casing;

at least one row of blades arranged in the main flow path;

a blade tip provided on the blade row, with the blade tip and the main flow path confinement performing a rotary movement relative to each other in a vicinity of the blade tip;

a peripheral guiding device connected to the main flow path confinement and extending into the main flow path, the peripheral guiding device including a row of profiles extending from the main flow path confinement into the main flow path;

a running gap positioned between the blade tip and the peripheral guiding device, with at least a portion of the running gap being retracted from the main flow path confinement;

wherein a running gap retraction depth at a leading edge of the blade tip, $t_V$, is larger than a running gap retraction depth at a trailing edge of the blade tip, $t_H$, and that the running gap, at least in a partial section, is inclined against the main flow path confinement and against the meridional flow;

wherein the main flow path confinement is S-shaped and the wedge-type shape of the peripheral guiding device results in a straight course of the blade tip and the running gap from the leading edge of the blade tip to the trailing edge of the blade tip.

23. A fluid flow machine, comprising:

a hub;

a casing;

a main flow path which is confined by the hub and casing;

at least one row of blades arranged in the main flow path;

a blade tip provided on the blade row, with the blade tip and the main flow path confinement performing a rotary movement relative to each other in a vicinity of the blade tip;

a peripheral guiding device connected to the main flow path confinement and extending into the main flow path, the peripheral guiding device including a row of profiles extending from the main flow path confinement into the main flow path;

a running gap positioned between the blade tip and the peripheral guiding device, with at least a portion of the running gap being retracted from the main flow path confinement;

wherein a running gap retraction depth at a leading edge of the blade tip, $t_V$, is larger than a running gap retraction depth at a trailing edge of the blade tip, $t_H$, and that the running gap, at least in a partial section, is inclined against the main flow path confinement and against the meridional flow;

wherein the leading edges of the peripheral guiding device profiles correspond to an aerodynamic sweep and are oriented obliquely to the running gap and obliquely to the main flow path confinement;

wherein the peripheral guiding device extends along an entire length of the blade tip and the running gap retraction depth continuously decreases from a forward gap endpoint of the peripheral guiding device to zero up to the trailing edge of the blade row.

24. A fluid flow machine, comprising:

a hub;

a casing;

a main flow path which is confined by the hub and casing;

at least one row of blades arranged in the main flow path;

a blade tip provided on the blade row, with the blade tip and the main flow path confinement performing a rotary movement relative to each other in a vicinity of the blade tip;

a peripheral guiding device connected to the main flow path confinement and extending into the main flow path, the peripheral guiding device including a row of profiles extending from the main flow path confinement into the main flow path;

a running gap positioned between the blade tip and the peripheral guiding device, with at least a portion of the running gap being retracted from the main flow path confinement;

wherein a running gap retraction depth at a leading edge of the blade tip, $t_V$, is larger than a running gap retraction depth at a trailing edge of the blade tip, $t_H$, and that the running gap, at least in a partial section, is inclined against the main flow path confinement and against the meridional flow;

wherein the profiles of the peripheral guiding device in a circumferential direction of the fluid flow machine have a wedge-type shape with maximum thickness at their trailing edge;

wherein an abradable coating in positioned at a rearward part of the bladed area of the blade row and the peripheral guiding device is recessed against the abradable coating in a radial direction, with the running gap in an area of the peripheral guiding device being larger than in an area of the abradable coating.

* * * * *